US010186751B2

(12) United States Patent
Tockweiler

(10) Patent No.: US 10,186,751 B2
(45) Date of Patent: Jan. 22, 2019

(54) PATIENT SUPPORT

(71) Applicant: Berchtold GmbH & Co. KG, Tuttlingen (DE)

(72) Inventor: Udo Tockweiler, Immendingen (DE)

(73) Assignee: BERCHTOLD GMBH & CO. KG, Tuttlingen (DE)

( * ) Notice: Subject to any disclaimer, the term of this patent is extended or adjusted under 35 U.S.C. 154(b) by 217 days.

(21) Appl. No.: 15/226,352

(22) Filed: Aug. 2, 2016

(65) Prior Publication Data

US 2017/0040664 A1 Feb. 9, 2017

(30) Foreign Application Priority Data

Aug. 3, 2015 (DE) ..... 10 2015 112 738

(51) Int. Cl.

| | |
|---|---|
| ***A61G 13/02*** | (2006.01) |
| ***H01Q 1/22*** | (2006.01) |
| ***A61G 13/08*** | (2006.01) |
| ***H01Q 1/36*** | (2006.01) |

(52) U.S. Cl.

CPC ..... *H01Q 1/2291* (2013.01); *A61G 13/02* (2013.01); *A61G 13/08* (2013.01); *H01Q 1/2208* (2013.01); *H01Q 1/36* (2013.01); *A61G 2205/60* (2013.01)

(58) Field of Classification Search

CPC ..... A61G 13/02

USPC ..... 5/613–618

See application file for complete search history.

(56) References Cited

U.S. PATENT DOCUMENTS

2008/0262657 A1* 10/2008 Howell ..... A47C 20/041 700/275
2009/0126112 A1 5/2009 Kuchenbecker et al.
2011/0214235 A1 9/2011 Schreuder et al.

FOREIGN PATENT DOCUMENTS

| | | | |
|---|---|---|---|
| DE | 4138319 | A1 | 5/1993 |
| DE | 102005054174 | A1 | 5/2007 |
| EP | 2062558 | A2 | 5/2009 |
| EP | 2702974 | A2 | 3/2014 |

OTHER PUBLICATIONS

Official Communication from Patent Office in Germany; dated: Mar. 1, 2016; 8 pages.

European Search Report for European Patent Application No. 16180988.4-1651 dated Nov. 16, 2016, 3 pages.

* cited by examiner

*Primary Examiner* — Fredrick C Conley

(74) *Attorney, Agent, or Firm* — Cantor Colburn LLP

(57) ABSTRACT

A patient support has two support parts which can be coupled to one another and which are pivotable relative to one another to exchange data between the two support parts.

20 Claims, 1 Drawing Sheet

PATIENT SUPPORT

Figure 1:
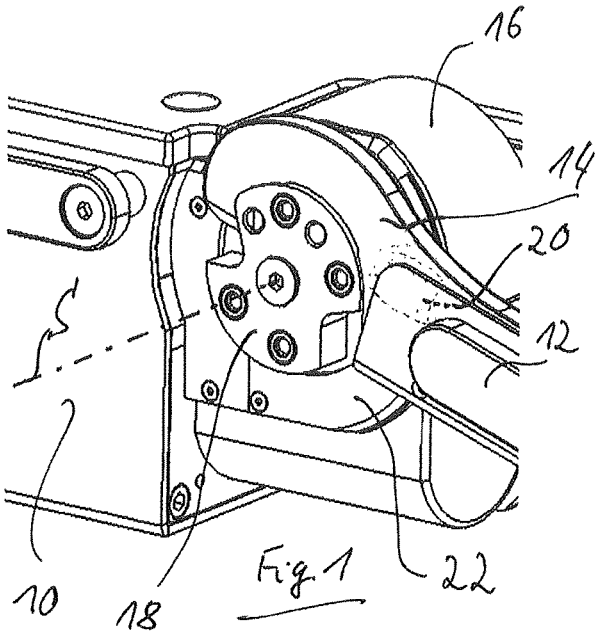

The present invention relates to a patient support, in particular for an operating table, having two support parts which can be coupled to one another and which are pivotable relative to one another about a pivot axis, wherein a transmission device is provided to transmit data and/or electrical energy between the two support parts.

Such patient supports of modular design, in particular for operating tables or examination tables, have the advantage that their lying surface or support surface can be variably composed of support parts in dependence on the situation and in accordance with the medical requirements and can be matched in complexity, position and configuration by pivoting the support parts relative to one another.

An unambiguous and safe identification of a support part connected indirectly or directly to an operating table is possible with respect to configuration and/or function by a transmission of data and/or electrical energy. An evaluation and control of the support parts as a whole can also take place on the basis of the identification in operation of an operating table. Since identification data of a support part can be transmitted to a control, the control can automatically recognize which support part it is or of which support parts the operating table is composed after receiving the identification data and corresponding configuration data can be generated in order, for example, to present a suitable operating menu and/or to suitably control an adjustment mechanism for the individual support parts.

It is the object of the present invention to further develop a patient support of the initially named kind such that a transmission of data and/or electrical energy is ensured at low cost, with small servicing effort and with easy operability.

This object is satisfied by the features of claim 1 and in particular in that the transmission device comprises a first component and a second component which communicate wirelessly with one another, wherein the components are likewise moved relative to one another about the pivot axis on a pivoting of one support part relative to the other support part. In accordance with the invention, a wireless communication is thus provided between the two support parts which is also ensured when the two support parts are pivoted relative to one another. In this manner, it is possible to dispense with mechanical contacts of any kind which not only require servicing and are prone to failure, but which are also associated with an increased mechanical and construction effort when ensuring a connection during a pivot movement.

Advantageous embodiments of the invention are described in the description, in the drawing and in the dependent claims.

In accordance with a first advantageous embodiment, a component can be a curved antenna. Such a curved antenna can, for example, be fastened to a stationary support part such that the second component, which is fastened to a pivotable support part, also remains in the region of the curved antenna during the pivoting. A reliable communication or transmission of data and/or electrical energy can thus take place over the total pivot range and in any pivot position.

It is advantageous for the antenna to extend along a circular segment concentric to the pivot axis since in this case the antenna and the second component always have the same spacing relative to one another and with respect to the pivot axis.

In accordance with a further embodiment, one component can be swept over by the other component on a pivoting of the support parts relative to one another. A wireless sliding contact is hereby formed which, however, enables a contactless communication or a contactless transmission of electrical energy.

In accordance with a further advantageous embodiment, the antenna is of planar design and has at least two windings disposed above one another. Such a planar antenna can be easily integrated into coupling elements between support parts of an operating table due to its compact construction, with a reliable transmission being ensured by means of the antenna by the provision of the windings disposed above one another.

In accordance with a further advantageous embodiment, one component can be an RFID chip which can in particular be installed at a removable mounting part. Such an RFID chip does not require its own energy supply or can be supplied with energy wirelessly over an antenna so that a data exchange can take place.

It can be advantageous for the two components to have substantially the same width relative to the pivot axis in the radial direction. It is ensured in this case that energy or data can be transmitted with the lowest possible losses.

In accordance with a further aspect, the invention relates to an antenna for use in a patient support of the above-described kind, wherein the antenna is planar and curved and in particular has at least two windings disposed above one another.

Figure 3:
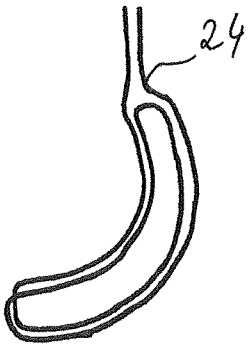
Figure 2:
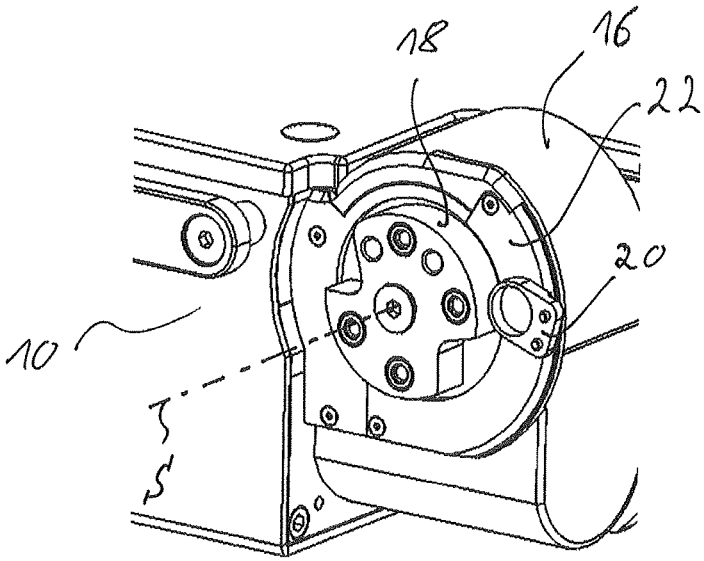

The present invention will be described in the following purely by way of example with reference to an advantageous embodiment and to the enclosed drawings. There are shown:

FIG. 1 a perspective view of a patient support with two support parts coupled to one another;

FIG. 2 the patient support of FIG. 1 without a coupled support part; and FIG. 3 a schematic view of an antenna.

FIG. 1 shows a patient support for an operating table, treatment table or the like having two support parts 10 and 12 which can be coupled to one another, with the actual support surface of the support part 12 not being shown, but rather only one of two coupling hooks 14 being recognizable in FIG. 1. In this respect, the support part 10, which is stationary in the embodiment shown, that is it is not held pivotably, has a drive motor 16 which pivots a coupling disk 18 about a pivot axis S. Since the support part 12 is hung by the coupling hook 14 to the coupling disk 18, the support part 12 is pivoted relative to the support part 10 by rotating the coupling disk 18 by means of the motor 16. It must additionally be mentioned that the arrangement shown in FIG. 1 is also present on the oppositely disposed side of the support parts so that a total of two motors 16 are provided which in total drive two coupling disks 18, with the support part 12 being releasably connected to the coupling disks 18 via two coupling hooks 14.

To transmit data and/or electrical energy between the two support parts 12, 14, a transmission device is provided which comprises a first coupling component and a second component which communication wirelessly with one another, with the components likewise being moved relative to one another about the pivot axis S on a pivoting of the support part 12 relative to the support part 10. In the embodiment shown, one component is an antenna and one component is an RFID chip 20. The RFID chip 20 is integrated into the coupling hook 14 and is therefore only shown dashed in FIG. 1. In the representation of FIG. 2, in contrast, the RFID chip 20 is shown in its position of FIG.

1; however, the support part 12 and the pivot hook 14 have been omitted in the representation.

As FIG. 1 and FIG. 2 illustrate, a curved antenna 22 is provided as one component of the transmission device which extends along a circular segment concentric to the pivot axis S over an angular range of approximately 75°. In this respect, the antenna 22, which has a thickness of some few millimeters in parallel with the pivot axis S, is arranged and fastened to the support part 10 about the pivot axis S such that the antenna 22 is swept over by the RFID chip 20 on a pivoting of the support part 12. Since the RFID chip 20 and the antenna 22 have substantially the same width relative to the pivot axis, viewed in the radial direction, and since the antenna 22 is concentric to the pivot axis S, the RFID chip 20 also always remains at the same radial position relative to the antenna 22 on a pivoting of the support part 12 relative to the support part 10.

The antenna 22 comprises a plastic housing which is fastened to the support part 10 by two screws, with an antenna wire 24 being molded into the plastic housing in a configuration such as is shown in FIG. 3. As FIG. 3 shows, the antenna wire 24 is shaped to form a first winding which extends in curved form from the feed up to the end of the antenna and back again. A second winding is formed in that the antenna wire is again guided in the direction of the first winding before the feed and is subsequently led in the same manner above or beneath the first winding in the direction of the feed.

The antenna 22 or the antenna wire 24 can then be connected to a control with whose aid the data contained in the RFID chip such as identification data, serial numbers, type designations, dimensions or the like can the read out so that the control obtains information on which support part 14 it is. It is also conceivable in this respect to integrate a rotary encoder into the antenna 22 so that the pivot position in which the support part 14 is actually located can simultaneously be read out.

The invention claimed is:

1. A patient support having two support parts which can be coupled to one another and which are pivotable relative to one another about a pivot axis, wherein a transmission device is provided to transmit at least one of data and electrical energy between the two support parts, the transmission device comprising a first component and a second component which communicate wirelessly with one another, with the first and second components likewise being moved relative to one another about the pivot axis on a pivoting of one support part relative to the other support part, one of the first and second components being a curved antenna, the curved antenna extending along a circular segment concentric to the pivot axis.

2. The patient support in accordance with claim 1, wherein the patient support is for an operating table.

3. The patient support in accordance with claim 1, wherein one of the first and second components is an RFID chip.

4. The patient support in accordance with claim 3, wherein the RFID chip is mounted at a removable support part.

5. The patient support in accordance with claim 1, wherein the first and second components have substantially the same width in a radial direction relative to the pivot axis.

6. The patient support in accordance with claim 1, wherein one of the first and second components can be operated without its own power supply.

7. A patient support having two support parts which can be coupled to one another and which are pivotable relative to one another about a pivot axis, wherein a transmission device is provided to transmit at least one of data and electrical energy between the two support parts, the transmission device comprising a first component and a second component which communicate wirelessly with one another, with the first and second components likewise being moved relative to one another about the pivot axis on a pivoting of one support part relative to the other support part, one of the first and second components being swept over by the other one of the first and second components on a pivoting of the support parts relative to one another.

8. The patient support in accordance with claim 7, wherein the patient support is for an operating table.

9. The patient support in accordance with claim 7, wherein one of the first and second components is an RFID chip.

10. The patient support in accordance with claim 9, wherein the RFID chip is mounted at a removable support part.

11. The patient support in accordance with claim 7, wherein the first and second components have substantially the same width in a radial direction relative to the pivot axis.

12. The patient support in accordance with claim 7, wherein one of the first and second components can be operated without its own power supply.

13. An antenna for use in a patient support having two support parts which can be coupled to one another and which are pivotable relative to one another about a pivot axis, wherein a transmission device is provided to transmit at least one of data and electrical energy between the two support parts, wherein the transmission device comprises a first component and a second component which communicate wirelessly with one another, with the first and second components likewise being moved relative to one another about the pivot axis on a pivoting of one support part relative to the other support part, and wherein the antenna is planar and curved.

14. The antenna in accordance with claim 13, wherein the antenna has at least two windings disposed above one another.

15. A patient support having two support parts which can be coupled to one another and which are pivotable relative to one another about a pivot axis, wherein a transmission device is provided to transmit at least one of data and electrical energy between the two support parts, the transmission device comprising a first component and a second component which communicate wirelessly with one another, with the first and second components likewise being moved relative to one another about the pivot axis on a pivoting of one support part relative to the other support part, one of the first and second components being a curved antenna, the curved antenna being planar and having at least two windings disposed above one another.

16. The patient support in accordance with claim 15, wherein the first and second components have substantially the same width in a radial direction relative to the pivot axis.

17. The patient support in accordance with claim 15, wherein one of the first and second components can be operated without its own power supply.

18. The patient support in accordance with claim 15, wherein the patient support is for an operating table.

19. The patient support in accordance with claim 15, wherein one of the first and second components is an RFID chip.

20. The patient support in accordance with claim 19, wherein the RFID chip is mounted at a removable support part.

* * * * *